US007194100B2

(12) United States Patent
Kühnel et al.

(10) Patent No.: US 7,194,100 B2
(45) Date of Patent: Mar. 20, 2007

(54) METHOD FOR INDIVIDUALIZING A HEARING AID

(75) Inventors: Volker Kühnel, Männedorf (CH); Andreas Von Buol, Zürich (CH)

(73) Assignee: Phonak AG, Stafa (CH)

( * ) Notice: Subject to any disclaimer, the term of this patent is extended or adjusted under 35 U.S.C. 154(b) by 402 days.

(21) Appl. No.: 09/829,700

(22) Filed: Apr. 10, 2001

(65) Prior Publication Data

US 2002/0146137 A1 Oct. 10, 2002

(51) Int. Cl.
*H04R 25/00* (2006.01)

(52) U.S. Cl. ..... 381/321; 381/56

(58) Field of Classification Search ..... 381/60, 381/320, 312, 23.1, 321; 73/585; 600/559
See application file for complete search history.

(56) References Cited

U.S. PATENT DOCUMENTS

RE34,961 E * 6/1995 Widin et al. ..... 703/6
5,729,658 A 3/1998 Hou
6,094,489 A * 7/2000 Ishige et al. ..... 381/60
6,327,366 B1 * 12/2001 Uvacek et al. ..... 381/60

FOREIGN PATENT DOCUMENTS

EP 0 661 905 7/1995

* cited by examiner

*Primary Examiner*—Sinh Tran
*Assistant Examiner*—Walter F Briney, III
(74) *Attorney, Agent, or Firm*—Pearne & Gordon LLP

(57) ABSTRACT

This invention relates to a method for the individualized adaptation of a hearing aid to a person. The method consists basically of the measurement and quantification by parameters of the loudness perception of the individual, weighted by a first factor. Also weighted is a standardized normal loudness perception and its parameters by a second factor. Finally, the weighted loudness perceptions and their parameters are used for determining the optimal settings of the hearing aid for the individual concerned. The advantage of the method according to this invention lies in the fact that it permits significantly better adaptation of the hearing aid to the individual person.

11 Claims, 2 Drawing Sheets

METHOD FOR INDIVIDUALIZING A HEARING AID

BACKGROUND OF THE INVENTION

This invention relates to a method for individualizing a hearing aid.

Successfully fitting a hearing-impaired individual with a hearing aid that is to correct for the hearing impairment is a critical factor which, among other things, determines the person's acceptance of the hearing aid. In this context it is not only the nature and degree of the hearing impairment that is of significance but there are various other factors as well, for instance the person's particular perception of loudness levels.

The disclosure document of the European patent application number EP-A2-0 661 905 describes one such method for fitting a person with a hearing aid. That earlier method addresses the correction of the damaged psycho-acoustic perception of an individual by a parameter adjustment in the hearing aid. The targeted correction uses as a reference value the statistically determined average auditory perception of persons with normal hearing.

The above-mentioned patent disclosure further indicates that a loudness scaling procedure is employed for establishing a dynamic-compression default setting in the hearing aid. This permits on an individualized basis the determination of the acquisition level in the case of inner-ear damage, and thus equally individualized compensation. Additional reference is made in this connection to the publications by Kiessling, Kollmeier and Diller titled "Outfitting and Rehabilitation with Hearing Aids" (1997, Thieme, Stuttgart, New York) and by Thomas Brand titled "Analysis and Optimization of Psychophysical Procedures in Audiology" (Oldenburg: Library and Information System of the University, 2000—148 pp., Oldenburg, Diss., Univ., 1999, ISBN 3-8142-0721-1).

The loudness standard serving as a reference was established based on a group of persons with normal hearing, employing, where possible, the same procedure for determining that standard auditory function that is used in the specific individual measurements.

Various investigations have made it evident that auditory perception can differ significantly even within the loudness standard. A summary of the data established is contained in the publication by C. Elberling titled "Loudness Scaling Revisited" (J Am Acad Audiol 10, pp 248 to 260, 1999).

SUMMARY OF THE INVENTION

It is therefore the objective of this invention to introduce a method for providing settings in the hearing aid which permit an improved adaptation of hearing aids to the loudness perception of the individual.

This is accomplished by means of the procedure specified in claim 1, with subsequent claims specifying desirable implementation versions of the invention.

The advantages offered by this invention are as follows: Both the auditory perception of the individual and the statistical average auditory perception of hearing-impaired persons as a function of their loss of hearing as well as the standard auditory perception of persons with normal hearing are taken into account in defining the settings of a hearing aid, appropriately weighted on the basis of data reliability, the result being optimized target parameters for adjusting the settings of the individual's hearing aid, and thus improved hearing of the individual. In other words, this invention has made it possible to obtain a target loudness level which is optimized for the loudness perception of the individual.

BRIEF DESCRIPTION OF THE DRAWINGS

The following description explains this invention in more detail with the aid of drawings in which.

DETAILED DESCRIPTION OF THE PREFERRED EMBODIMENTS

Figure 1:
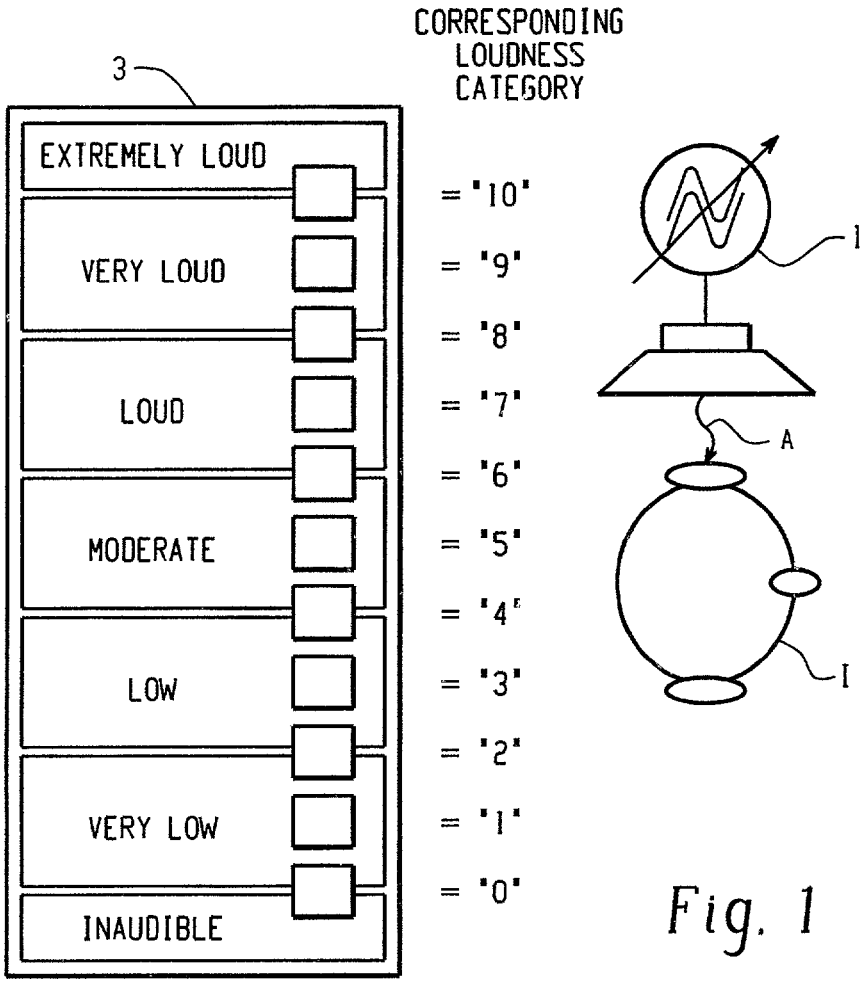
FIG. 1 is a schematic illustration of a quantification unit serving to quantify an individually perceived loudness level.

As is already evident from the introductory statements, the invention provides the possibility of an individualized and consequently better adjustment of hearing aids by virtue of the fact that the hearing-aid setting takes into account deviations attributable to inaccurate measurements as well as scattered values resulting from different individual loudness perceptions, with appropriately weighted individually established parameters as well as the standard loudness perception contributing to the definition of optimal adaptation. The term "optimal adaptation" in this case refers in particular to the setting of a balanced compression pattern and of the amplification, i.e. the frequency-dependent input/output characteristics of the hearing aid.

In terms of the compression, this is accomplished in particular by plotting the specific gradients of the individual scaling results as a function of the loss of hearing and approximating them by a specific LOHL function, i.e. by the gradient of the loudness factor as a function of the hearing loss HL. The individual LOHL function when compared to the average hearing-impaired LOHL function permits the determination of a factor which describes the loudness sensitivity of the individual in comparison with the standard.

In terms of the amplification, this is accomplished by plotting the specific levels L0 of the individual scaling results as a function of the hearing loss and approximating them by a specific HLL0 factor, where the level for loudness=0 as a function of the loss of hearing HL. The individual HLL0 factor, compared to the average HLL0 factor of the hearing-impaired, permits the determination of an offset which describes the mean value of the difference in the abscissa of the loudness function of the individual in comparison with the standard.

The following is a step-by-step explanation of the procedure for the adaptation of a hearing aid.

First, an audiogram is prepared. For a potential wearer of a hearing aid this is done by measuring the hearing thresholds for pure sounds at different frequencies. The increments of these audible limits are expressed and plotted as hearing loss in dB for each frequency and at certain frequency intervals. The audiogram thus allows for the determination of the auditory range in which there is a hearing loss. The audiogram also establishes data sampling points, meaning individual frequencies, at which loudness scaling is subsequently performed in the manner described next.

The loudness "L" is a psycho-acoustic variable which indicates how "loud" an acoustic signal is perceived by an individual.

In the case of natural acoustic signals which are always broad-band signals, the loudness does not necessarily match the physically transmitted energy of the signal. A psycho-acoustic analysis of the impinging acoustic signal takes place in the ear within individual frequency bands, the so-called critical bands. The loudness is determined by a band-specific processing of the signal and an inter-band superposition of the band-specific processing results, known as "loudness summation". These basic principles were described in detail by E. Zwicker in "Psychoacoustics", Springer-Verlag Berlin, academy edition, 1982.

It has been found, however, that loudness must be viewed as one of the most essential psycho-acoustic variables determining acoustic perception.

One possibility to use the loudness individually perceived in response to selected acoustic signals as a variable for further processing is offered by the method schematically illustrated in FIG. 1 and described for instance by O. Heller in "Auditory Range Audiometry Employing the Categorization Method", Psychological Articles 26, 1985, or by V. Hohmann in "Dynamics Compression for Hearing Aids, Psychoacoustical Fundamentals and Algorithms", thesis at the Univ. of Göttingen ottingen, VDI-Verlag, Series 17, No. 93, or by Thomas Brand in "Analysis and Optimization of Psychophysical Procedures in Audiology", (Oldenburg: Library and Information System of the University, 2000—148 pp., Oldenburg, Diss., Univ., 1999, ISBN 3-8142-0721-1). According to that method, a person I is exposed to an acoustic signal A which can be varied in a generator 1 in terms of its spectral composition and its transmitted sound pressure level. The person I analyzes i.e. "categorizes" the acoustic signal A just heard by means of an input unit 3 within for instance eleven loudness steps or categories as illustrated in FIG. 1. These steps are assigned numerical weights for instance from 0 to 10 categorical units (cu).

By means of this approach it is possible to measure or quantify the specific loudness perceived. According to this invention, the process, hereinafter referred to as loudness scaling, is performed at a minimum of one and preferably at three different frequencies or data sampling points.

Figure 2:
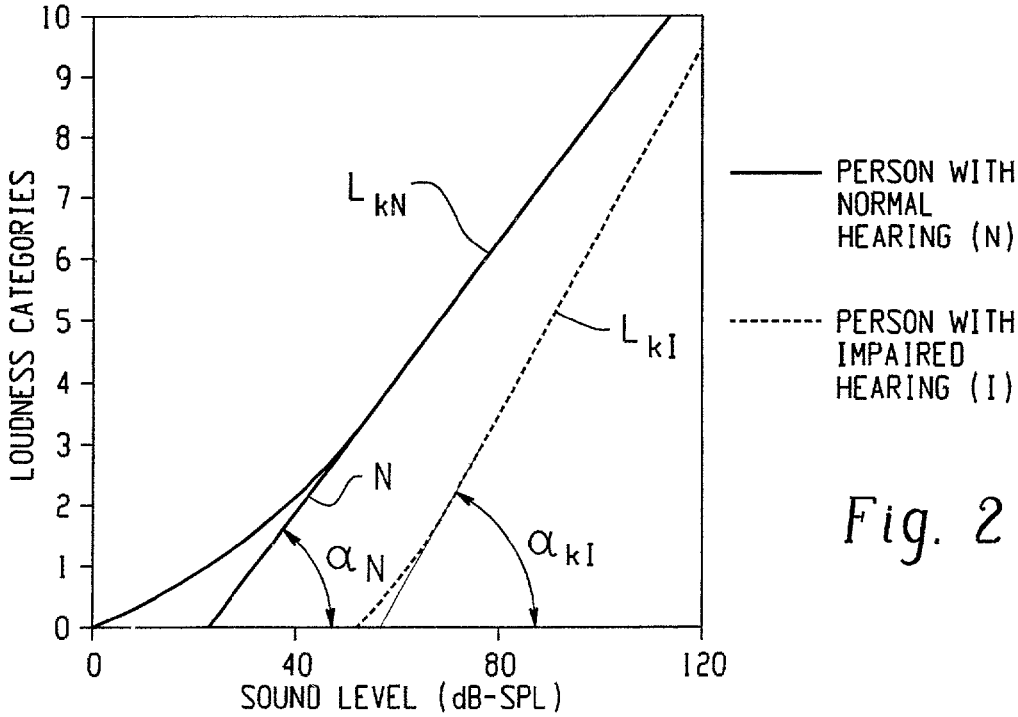
FIG. 2 indicates the loudness level perceived by a person with normal hearing and, respectively, by a person with impaired hearing, as a function of volume and at a specific frequency.

In FIG. 2 the loudness L, registered by category scaling per FIG. 1, is expressed as function of the mean sound pressure level in dB-SPL for a sinusoidal signal of frequency $f_k$. As is evident from the pattern in FIG. 2, the loudness $L_{kN}$ of the standard in the graph chosen increases in nonlinear fashion with the signal level; in a first approximation the slope for persons with normal hearing is expressed for all critical bands by the regression line indicated as N in FIG. 2 with a gradient $\alpha_N$ in [categories per dB-SPL].

It is quite evident from this illustration that the model parameter $\alpha_N$ corresponds to a nonlinear amplification which for persons with normal hearing is approximately the same in each critical frequency band, whereas for hearing-impaired persons the determination must be made using $\alpha_{kI}$ for each frequency or frequency band.

The straight line with the gradient $\alpha_{kI}$ serves to approximate the nonlinear loudness function at frequency $f_k$ by means of a regression line.

In FIG. 2, $L_{kI}$ indicates the typical pattern of loudness $L_I$ of a hearing-impaired person at a frequency of $f_k$.

A comparison of the curves $L_{kN}$ and $L_{kI}$ shows that the curve of a hearing-impaired person displays a greater offset ($L_o$) relative to zero and has a steeper slope than the standard curve. The greater offset corresponds to a higher audible limit or hearing threshold; the phenomenon of the invariably steeper loudness curve is referred to as loudness "recruitment" or acquisition and reflects a higher α-parameter.

As pointed out further above, loudness scaling is performed at a minimum of one and preferably at three reference or data sampling points, i.e. at one or several different frequencies. Based on these reference values a so-called LOHL factor is established by plotting the gradients of the loudness factor $a_1$, $a_2$, $a_3$ . . . as a function of hearing loss HL in dB.

Figure 3:
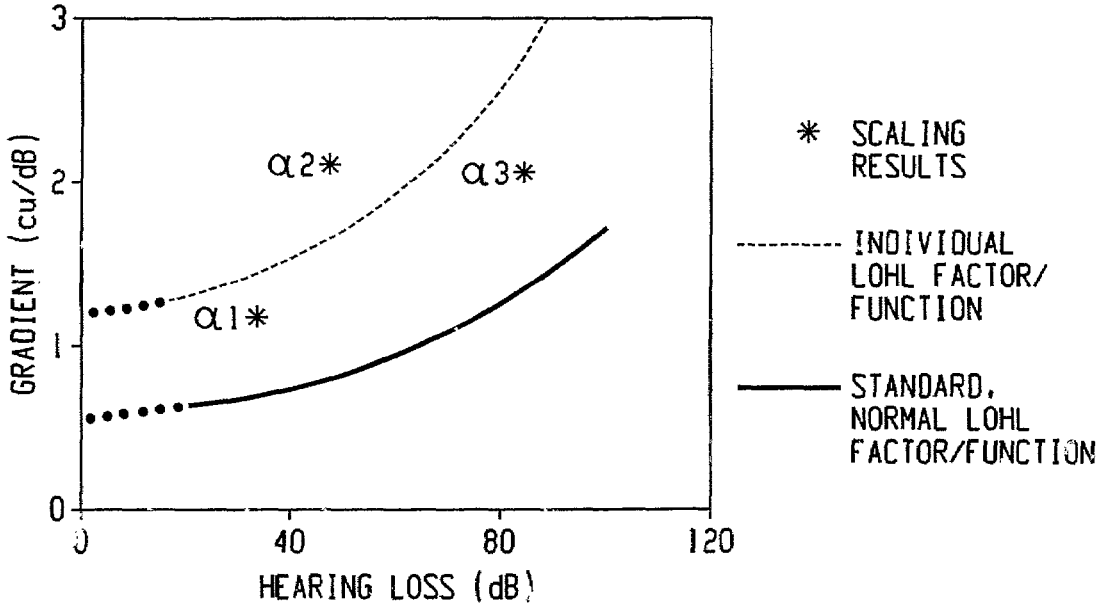
FIG. 3 shows the loudness correction as a function of the loss of hearing (HVLS/LOHL function) of a hearing-impaired person.

FIG. 3 shows an LOHL function for a hearing-impaired person, with the individual LOHL function, represented by the dashed line, established via three data sampling points for building a suitable model as explained below.

The following model has been found to be particularly useful in determining the gradient a as a function of hearing loss HL (for hearing loss between 20 dB and 100 dB):

$$\log_{10}=a_a \times HL + b_a \times \log(HL) + VP_{consta} \text{ for } 20\ \text{dB} < HL < 100\ \text{dB},$$

where

−α=gradient of the loudness function,

HL=hearing loss in dB, $a_a$, $b_a$=constant function parameter, and $VP_{consta}$=the individual function parameter which adapts the LOHL factor to the data sampling points $a_1$, $a_2$, $a_3$, . . .

It should be mentioned at this juncture that, having been extrapolated from several data sampling points, the individual LOHL factor illustrated in FIG. 3 shows less dispersion-related deviation than do the sampling points by themselves, thus providing a better reflection of changes in individual perception. Although it would be possible to obtain the targeted reference settings for the hearing aid already on the basis of this individual LOHL factor, to determine the gradient a at 0 dB hearing loss by extrapolation (dotted curve in FIG. 3) and to set the hearing aid accordingly, it has been found that the setting of the hearing aid can be substantially improved if data on the healthy ear are also included in the equation. According to the invention the normal loudness perception should be used as a reference for determining the individually needed compression at 0 dB hearing loss. In the process, according to the invention, the fact is taken into account that even the loudness perception of persons with normal hearing tends to vary to a more than negligible extent.

As a preferred solution for including the normal-loudness factor, a mean value is established between the individual gradient α at 0 dB hearing loss, determined by measurements and by extrapolation, and the normal-loudness gradient, weighting the values based on their expected dispersion both for the individual gradient α at 0 dB hearing loss and for the normal-loudness gradient. Weighting the individual scaling data as a function of their respective quality and of the number of measuring points for the various scaling functions and the number of scaling operations themselves has proved to be useful. For individual scaling data of average quality at three frequencies, a weighting of the individual gradient α at 0 dB hearing loss by a factor of ⅔ and a weighting of the normal-hearing gradient $\alpha_N$ by a factor of ⅓ can lead to an exceedingly good adaptation of the hearing aid.

Similar to the gradient α for the loudness function, the abscissa section $L_0$ of the loudness factor in conjunction with the hearing loss information established in the audiogram permits the determination of an optimum band-specific amplification.

As pointed out further above, loudness scaling is performed at a minimum of one and preferably at three reference or data sampling points, i.e. at one or several different frequencies. Based on these data points the HLL0 factor is established by plotting the abscissa sections for the loudness factor $L_{01}$, $L_{02}$, $L_{03}$, . . . as a function of hearing loss HL in dB.

Figure 4:
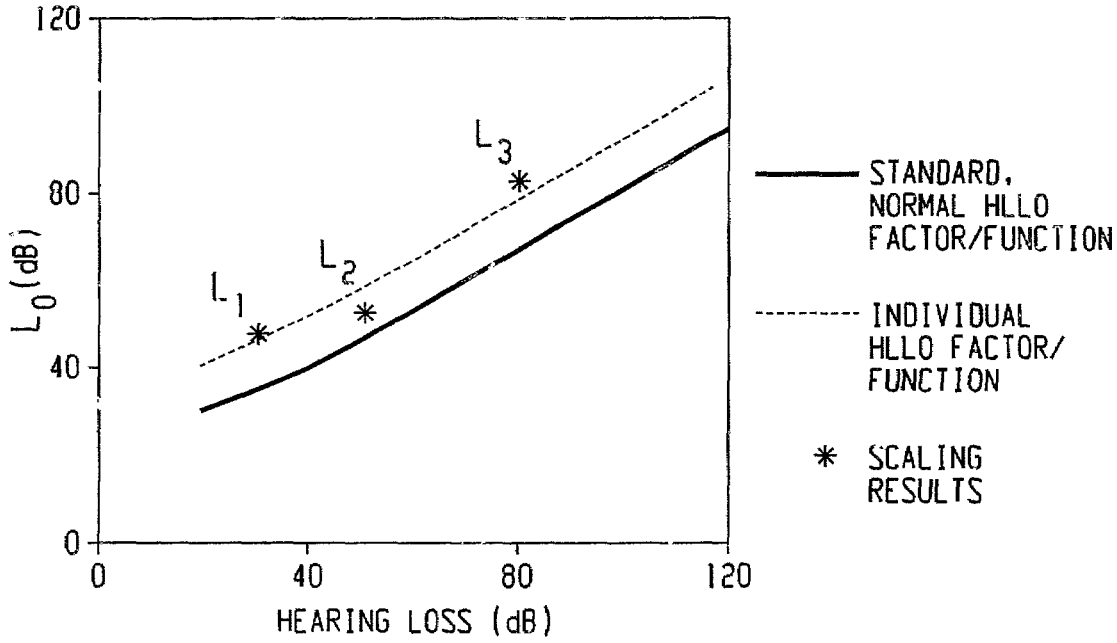
FIG. 4 shows the level for loudness=0 as a function of hearing loss (HVLO/HLLO function) for a hearing-impaired person.

FIG. 4 shows the HLL0 factor for a hearing-impaired person with the individual HLL0 function, represented by the dashed line, established via three data sampling points for building a suitable model as explained below.

The following model has been found to be particularly useful in determining $L_0$ as a function of hearing loss HL (for hearing loss between 20 dB and 100 dB):

$$L0=a_L\times HL+b_{L\times}\log(HL)+VP_{constL}\text{for 20 dB}<HL<100\text{ dB},$$

where $L_0$=level of loudness=0,

HL=hearing loss in dB, $a_L$, $b_L$=constant function parameter, and $VP_{constL}$=individual function parameter which adapts the HLL0 function to the data sampling points $L_{01}$, $L_{02}$, $L_{03}$, . . .

It should be mentioned at this juncture that, having been extrapolated from several data sampling points, the HLL0 factor illustrated in FIG. 4 shows less dispersion-related deviation than do the sampling points by themselves, thus providing a better reflection of changes in individual perception. Although it would be possible to obtain the targeted reference settings for the hearing aid already on the basis of this individual HLL0 factor, to determine the level $L_0$ at 0 dB hearing loss by extrapolation (dotted curve in FIG. 3) and to set the hearing aid accordingly, it has been found that the setting of the hearing aid can be substantially improved if, similar to the gradient a, data on the healthy ear are also included in the equation. According to the invention the standard i.e. normal loudness perception should be used as a reference for determining the individually needed compression at 0 dB hearing loss. In the process, according to the invention, the fact is taken into account that even the loudness perception of persons with normal hearing tends to vary to a more than negligible extent.

As a preferred solution for including the normal-loudness factor, a weighted mean value is established between the individual level $L_0$ at 0 dB hearing loss, determined by measurements and by extrapolation, and the normal level $L_0$, weighting the values based on their expected dispersion both for the individual level $L_0$ at 0 dB hearing loss and for the normal level $L_0$. For the level $L_0$ as well, similar to the gradient of the loudness factor, weighting the individual scaling data as a function of their respective quality and of the number of measuring points for the various scaling functions and the number of scaling operations themselves has proved to be useful.

For individual scaling data of average quality at three frequencies, a weighting of the individual level $L_0$ at 0 dB hearing loss by a factor of ⅓ and a weighting of the normal-level $L_0$ by a factor of ⅔ can lead to an exceedingly good adaptation of the hearing aid.

The invention claimed is:

1. A method for individualizing a hearing aid in adaptation to a loudness perception of an individual, said method comprising the steps of:

adjusting the hearing aid using both (1) measure and qualified loudness perception parameters of the individual weighted by a first factor and (2) normal loudness perception parameters weighted by a second factor; and adjusting compression and/or amplification in the hearing aid, for which purpose the compression and, respectively, the application are each determined as a function of frequency, wherein for determining the compression, the loudness perception of the individual is quantified by means of LOHL factor which is determined by loudness scaling at a minimum of one frequency.

2. Method as in claim 1, wherein the LOHL factor is modeled using the equation:

$$\log_{10}(\alpha)=a_a\times HL+b_a\times\log(HL)+VP_{consta}$$

where

α=gradient of the loudness function,

HL=hearing loss in dB, $a_a$, $b_a$=constant function parameter, and $VP_{consta}$=the individual function parameter which adapts the LOHL factor to the data sampling points $\alpha_1$, $\alpha_2$, $\alpha_3$, . . . , and that $VP_{consta}$ is determined on the basis of a loudness scaling performed at a minimum of one frequency.

3. A method for individualizing a hearing aid in adaptation to a loudness perception of an individual, said method comprising the steps of:

measuring and quantifying loudness perception parameters of the individual, weighted by a first factor;

weighting of normal loudness perception parameters by a second factor;

combining the weighted loudness perception parameters of the individual with the weighted normal loudness perception parameters to define a weighted loudness parameter; and using the weighted loudness parameter for adjusting the hearing aid, wherein compression and/or amplification is/are adjusted in the hearing aid, for which purpose the compression and, respectively, the amplification are each determined as a function of frequency, and wherein, for determining the amplification, the loudness perception of the individual is quantified by means of an HLL0 factor which is defined by loudness scaling at a minimum of one frequency.

4. The method as in claim 3, wherein the HLL0 factor is modeled using the equation:

$$L_0=a_L\times HL+b_L\times\log(HL)+VP_{constL},$$

where $L_0$=level of loudness=0,

HL=hearing loss in dB, $a_L$, $b_L$=constant function parameter, and $VP_{constL}$=individual function parameter which adapts the HLL0 function to the data sampling points $L_{01}$, $L_{02}$, $L_{03}$, . . . , and that $VP_{consta}$ is determined on the basis of a loudness scaling performed at a minimum of one frequency.

5. A method for individualizing a hearing aid in adaptation to a loudness perception of an individual, said method comprising the steps of:

measuring and quantifying loudness perception parameters of the individual, weighted by a first factor;

weighting of normal loudness perception parameters by a second factor;

combining the weighted loudness perception parameters of the individual with the weighted normal loudness perception parameters to define a weighted loudness parameter; and using the weighted loudness parameter for adjusting the hearing aid, wherein compression and/or amplification is/are adjusted in the hearing aid, for which purpose the compression and, respectively, the amplification are each determined as a function of frequency, and wherein, for determining the compression, the loudness perception of the individual is quantified by means of a LOHL factor which is determined by loudness scaling at a minimum of one frequency.

6. The method as in claim 5, wherein the LOHL factor is modeled using the equation:

$$\log_{10}(\alpha)=a_a \times HL+b_a \times \log(HL)+VP_{consta}$$

where $\alpha$=gradient of the loudness function,

HL=hearing loss in dB, $a_a$, $b_a$=constant function parameter, and $VP_{consta}$=the individual function parameter which adapts the LOHL factor to the data sampling points $\alpha_1$, $\alpha_2$, $\alpha_3$, . . . , and that $VP_{consta}$ is determined on the basis of a loudness scaling performed at a minimum of one frequency.

7. The method as in one of the claims 2 to 4 and 6, wherein the hearing loss is used for determining the frequencies at which loudness scaling is performed.

8. The method as in one of the claims 1 to 4 and 5 to 6, wherein the value of the weighted factors depends on the assumed and/or determined accuracy of the loudness scaling data.

9. The method as in claim 8, further comprising the selection of a value of ⅓ for the first factor and/or a value of ⅔ for the second factor.

10. The method as in claim 5, further comprising the selection of a value of ⅔ for the first factor and/or a value of ⅓ for the second factor.

11. A method for individualizing a hearing aid in adaptation to a loudness perception of an individual, said method comprising the steps of:

measuring and quantifying loudness perception parameters of the individual, weighted by a first factor;

weighting of normal loudness perception parameters by a second factor;

combining the weighted loudness perception parameters of the individual with the weighted normal loudness perception parameters to define a weighted loudness parameter; and using the weighted loudness parameter for adjusting the hearing aid, wherein compression and/or amplification is/are adjusted in the hearing aid, for which purpose the compression and, respectively, the amplification are each determined as a function of frequency, and wherein for determining the amplification, the loudness perception of the individual is quantified by means of one of an HLL0 factor and an LOHL factor, which is defined by loudness scaling at a minimum of one frequency.

* * * * *

UNITED STATES PATENT AND TRADEMARK OFFICE

CERTIFICATE OF CORRECTION

PATENT NO. : 7,194,100 B2
APPLICATION NO. : 09/829700
DATED : March 20, 2007
INVENTOR(S) : Volker Buhnel et al.

It is certified that error appears in the above-identified patent and that said Letters Patent is hereby corrected as shown below:

| | |
|---|---|
| Column 3, line 26: | Please delete “ottingen”. |
| Column 4, line 16: | Please delete the letter “a” after gradient, and insert therefor --$\alpha$--. |
| Column 4, line 18: | Please delete “$a_\alpha$”, and insert therefor --$\alpha_a$--. |
| Column 4, line 27, | Please delete “$a_1$”, and insert therefor --$\alpha_1$--. |
| Column 4, line 27, | Please delete “$a_2$”, and insert therefor --$\alpha_2$--. |
| Column 4, line 28, | Please delete “$a_3$”, and insert therefor --$\alpha_3$--. |
| Column 6, line 20, | Please delete “the”, and insert therefor --an--. |
| Column 6, line 21, | Please delete “the”. |
| Column 6, line 52, | Pleaase insert --a-- before the word “level”. |
| Column 6, line 53, | Please insert --a-- before the word “hearing”. |
| Column 6, line 55, | Please insert --a-- before the word “constant”. |
| Column 6, line 56, | Please insert --an-- before the word “individual”. |
| Column 7, line 20, | Please insert --a-- before the word “gradient”. |

UNITED STATES PATENT AND TRADEMARK OFFICE

CERTIFICATE OF CORRECTION

PATENT NO. : 7,194,100 B2
APPLICATION NO. : 09/829700
DATED : March 20, 2007
INVENTOR(S) : Volker Buhnel et al.

It is certified that error appears in the above-identified patent and that said Letters Patent is hereby corrected as shown below:

Column 7, line 21, Please insert --a-- before the word "hearing".

Column 7, line 23, Please insert --an-- before the word "individual".

Signed and Sealed this

Seventeenth Day of June, 2008

JON W. DUDAS
*Director of the United States Patent and Trademark Office*